US007614413B1

(12) United States Patent
Ma

(10) Patent No.: US 7,614,413 B1
(45) Date of Patent: Nov. 10, 2009

(54) CONNECTING DEVICE FOR UMBRELLA RIBS

(76) Inventor: Joen-Shen Ma, 12F, No. 578, Kwang Fu South Rd., Taipei (TW)

( * ) Notice: Subject to any disclaimer, the term of this patent is extended or adjusted under 35 U.S.C. 154(b) by 0 days.

(21) Appl. No.: 12/155,351

(22) Filed: Jun. 3, 2008

(51) Int. Cl.
*A45B 25/02* (2006.01)

(52) U.S. Cl. ..... 135/32; 135/31; 135/29; 403/157

(58) Field of Classification Search ..... 135/29, 135/31–32, 15.1, 33.4; 403/62, 150, 157
See application file for complete search history.

(56) References Cited

U.S. PATENT DOCUMENTS 5,372,155 A * 12/1994 You ..... 135/29
5,433,233 A * 7/1995 Shiran et al. ..... 135/20.1
5,715,853 A * 2/1998 Lin ..... 135/29
6,102,058 A * 8/2000 You ..... 135/29
6,167,894 B1 * 1/2001 Lin ..... 135/15.1
7,254,869 B2 * 8/2007 You ..... 16/326

* cited by examiner

*Primary Examiner*—Winnie Yip
(74) *Attorney, Agent, or Firm*—Rosenberg, Klein & Lee

(57) ABSTRACT

The present invention generally relates to a connecting device designed for connecting umbrella ribs and specifically refers to one installed on each pivoted part existing among all lengthwise ribs and transverse ribs and it contains a hollow tubular sleeve sheathed on the lengthwise rib and a socket sleeve mounted on the top of the transverse rib. The hollow tubular sleeve has two symmetrical elongated wings where the pinholes existed respectively. The socket sleeve is the same as the hollow tubular sleeve having two symmetrical elongated wings where pinholes are on the same line with the central bore located on the top of the socket sleeve. There are slots formed between the socket sleeve and its two symmetrical elongated wings for receiving two symmetrical elongated wings of the hollow tubular sleeve. By using a rivet to pivotally connect the hollow tubular sleeve coupled on the lengthwise rib with the socket sleeve set on the top of the transverse rib together, thus linking the lengthwise rib and transverse rib collectively and that greatly enhancing the connecting strength of the pivoted part thereof.

1 Claim, 5 Drawing Sheets

CONNECTING DEVICE FOR UMBRELLA RIBS

BACKGROUND OF THE INVENTION

1. Field of the Invention

The present invention generally relates to a connecting device designed for connecting umbrella ribs, specifically a connecting device installed on each pivoted part existing in each and every one of the lengthwise rib and transverse rib and it connects the lengthwise rib and transverse rib with a hollow tubular sleeve having two symmetrical elongated wings thereof and a socket sleeve forming receiving slots between its two symmetrical elongated wings; thus enabling the connection of lengthwise rib and transverse rib, and further greatly enhancing the connecting strength of pivoted parts among all joined lengthwise ribs and transverse ribs.

2. The Related Arts

The commonly known umbrellas such as a small-size umbrella, a parasol or a large-size garden umbrella or a beach umbrella, are slightly different in their usages and shapes, but the basic open and close rule and structure are pretty much the same; they all disclose a central tubular post, a lower crown, an upper crown, several transverse ribs and equivalent quantities of lengthwise ribs, and a canopy cloth. The aforesaid upper crown is fixed on the top of the central tubular post while the lower crown is movable up and down the central tubular post, and by the stretching motion of these transverse ribs and lengthwise ribs, you can open or close the canopy cloth.

As above indicated, by the stretching motion of these transverse ribs and lengthwise ribs, you can open or close the canopy cloth; structurally, on the top of every transverse rib is pivotally connected with the lengthwise rib by a member generally called as "butterfly" (that is the hollow tubular sleeve in our case) in the industry. When the lower crown is sliding up and down the central tubular post, allowing the transverse ribs to bring along the lengthwise ribs to open and close an umbrella.

However, conventional umbrella has various degrees of wear on its pivoted parts existed among those transverse ribs and lengthwise ribs. As time goes by, the pivoted parts become more and more fragile and that contributing to the decrease of connecting strength of pivoted parts; moreover it results in serious deformations of umbrella ribs which further cause the inconvenience of opening and closing an umbrella. These are the most common disadvantages of conventional umbrella.

Therefore, it is desired to have an improvement on the connecting device for umbrella ribs to overcome the shortages of conventional umbrella.

SUMMARY OF THE INVENTION

Thus, the present invention is made to overcome the drawbacks of the conventional umbrella, and presenting an improved connecting device for umbrella ribs.

A primary objective of the present invention is to provide a connecting device for those pivoted parts among these lengthwise ribs and transverse ribs that can greatly increases the connecting strength of those pivoted parts.

To realize the above objective, the present invention provides an improved connecting device for umbrella ribs having the following technical features.

The present invention is inclusive of a hollow tubular sleeve coupled on the lengthwise rib and a socket sleeve mounted on the top of the transverse rib.

The said hollow tubular sleeve has two symmetrical elongated wings where have pinholes thereon. The hollow tubular sleeve can be sheathed into the middle of lengthwise rib for connecting the socket sleeve fixed on the top of the transverse rib.

The above described socket sleeve also has two symmetrical elongated wings where there are pinholes on the same line with the central bore located on the top of the socket sleeve; two receiving slots has being constructed to hold two symmetrical elongated wings of the said hollow tubular sleeve inside. The socket sleeve is fixed on the top of the transverse rib to connect with the hollow tubular sleeve equipped on the lengthwise rib.

By taking use of a rivet to pivotally joined the hollow tubular sleeve set on lengthwise rib with the socket sleeve located on the top of transverse rib, thus forming a connecting status between the lengthwise rib and the transverse rib.

The complete assembly of our present invention will be two symmetrical elongated wings of the hollow tubular sleeve to be received within the slots between the socket sleeve and the two symmetrical elongated wings thereof; in other words, the rivet is perforating individually through one elongated wing of socket sleeve, one elongated wing of hollow tubular sleeve, central bore of socket sleeve, the other elongated wing of hollow tubular sleeve and finally the other elongated wing of socket sleeve to be joined together. The aforesaid described structure design has broadened the pivoted part of the hollow tubular sleeve and the socket sleeve, enabling the increase of the connecting strength between the hollow tubular sleeve and the socket sleeve and further fulfilling the expected objective of our present invention.

The above mentioned invention, due to its simple structure, is suitable to be used in the umbrella ribs of various large-size umbrellas such as garden umbrella and beach umbrella for strengthening the structure of umbrella ribs thereof; naturally the connecting device for umbrella ribs of present invention is also applicable to small-size personalized umbrellas as well.

In combination with the following drawings enclosed to illustrate the preferred embodiment of the present invention in detailed.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
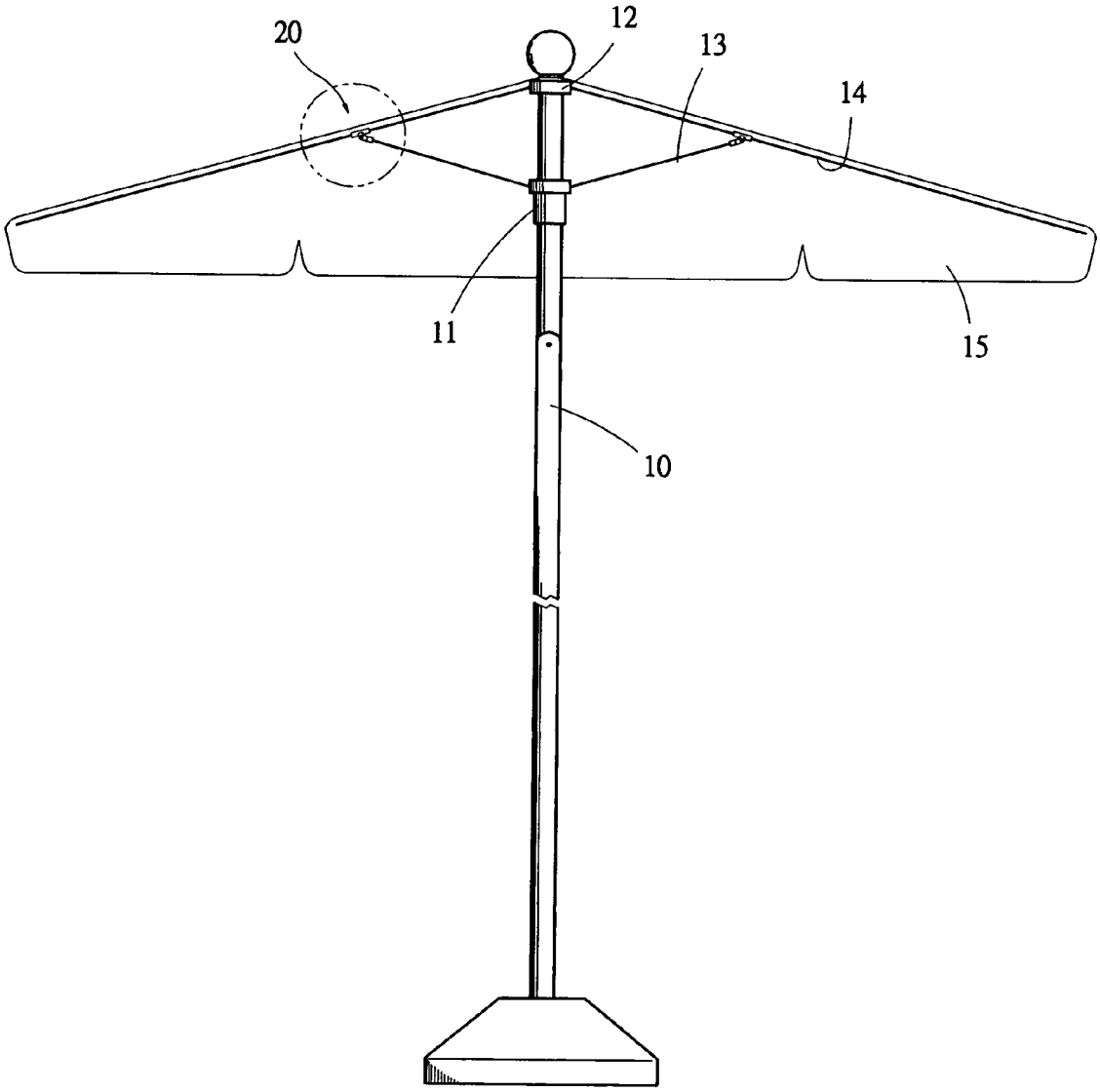
FIG. 1 shows an umbrella structure outline view which has installed with the connecting device 20 in accordance with a preferred embodiment of the present invention.

With reference to the drawings and in particular to FIG. 1, which shows an umbrella structure outline view of the connecting device 20 constructed in accordance with a preferred embodiment of the present invention.

Figure 2:
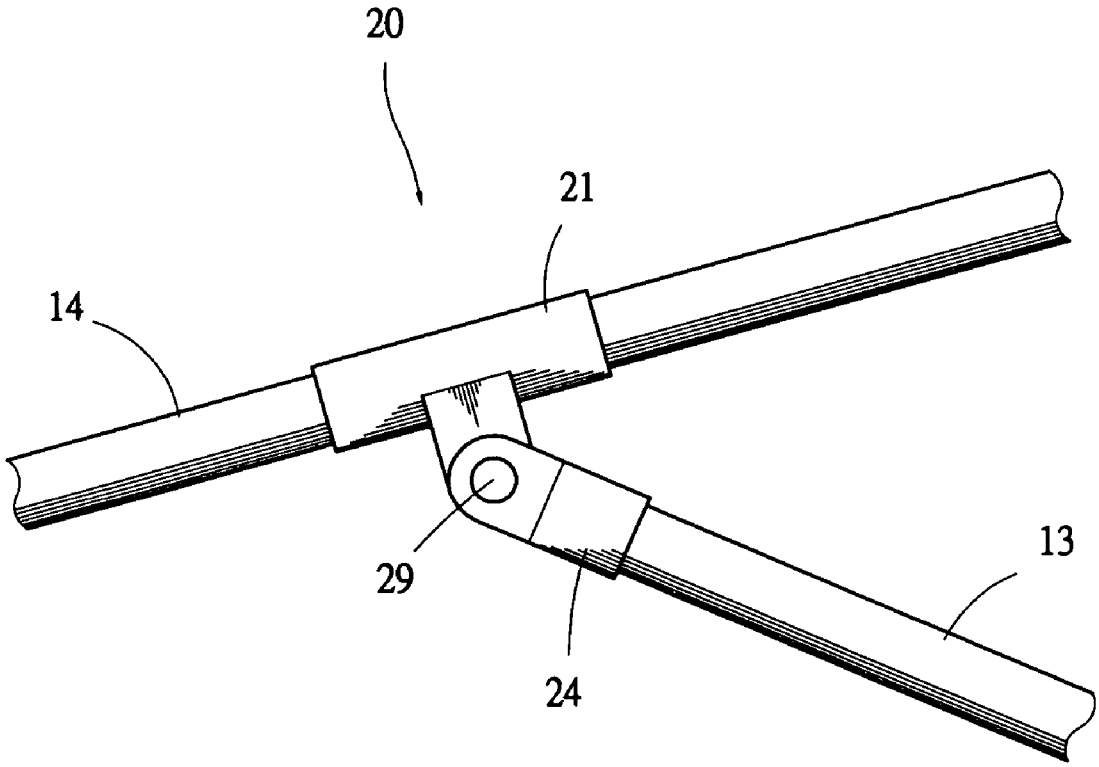
FIG. 2 shows an enlarged view of the connecting device 20 from the FIG. 1 of the present invention where it located.

With reference to the drawings and in particular to FIG. 2 shows an enlarged view of the connecting device 20 from the FIG. 1 of the present invention.

As shown in FIGS. 1 and 2, the connecting device 20 in accordance with the present invention is installed on each one of the pivoted part between each lengthwise rib 14 and each transverse rib 13 of an umbrella.

As shown in FIG. 1, the said umbrella is consisting of a central tubular post 10, a lower crown 11, an upper crown 12, several transverse ribs 13 and equivalent quantities of lengthwise ribs 14, and a canopy cloth 15. The aforesaid upper crown 12 is fixed on the top of the central tubular post 10 while the lower crown 11 is movable up and down the central tubular post 10, and by stretching the transverse ribs 13 and lengthwise ribs 14, you can open or close the canopy cloth 15.

Figure 3:
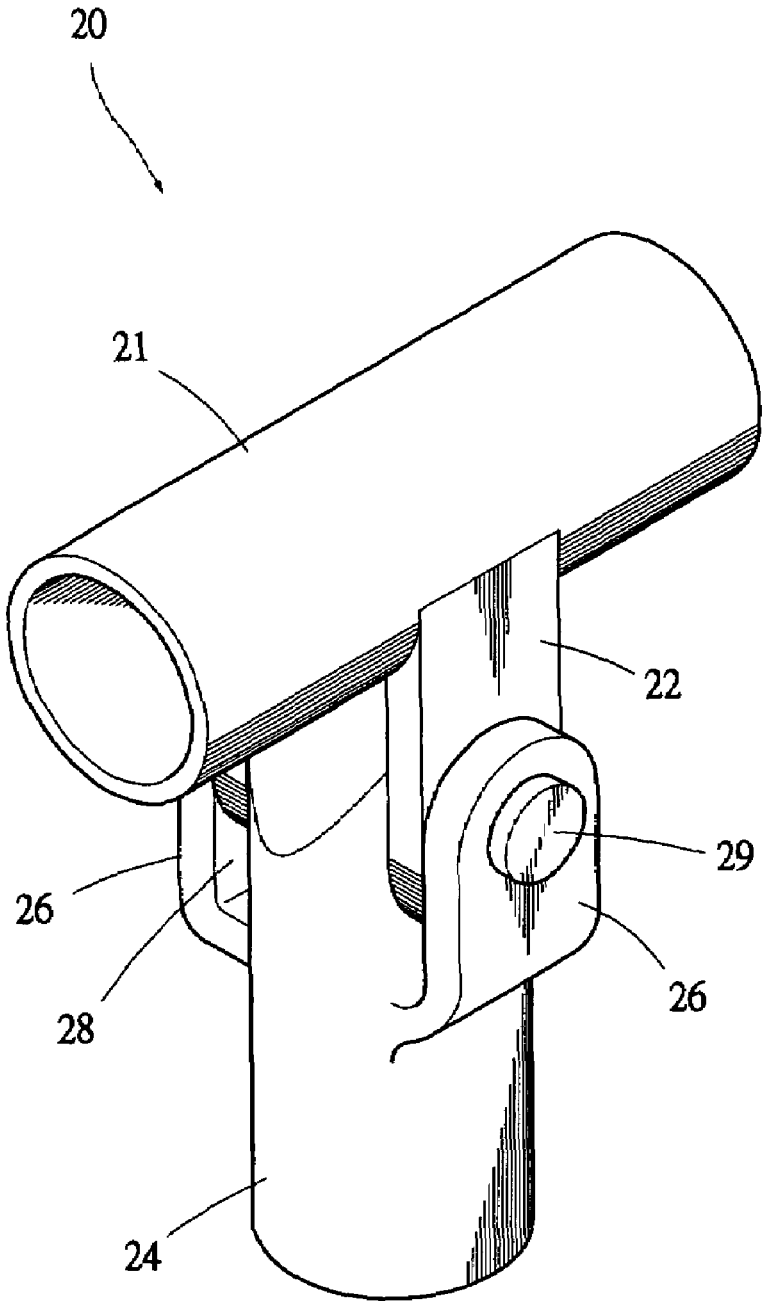
FIG. 3 shows a stereogram view of the connecting device 20 of the present invention.

With reference to the drawings and in particular to FIG. 3 which shows a stereogram view of the connecting device 20 of the present invention.

As shown in FIG. 2 and FIG. 3, the connecting device 20 of present invention contains a hollow tubular sleeve 21 sheathed in lengthwise 14 and a socket sleeve 24 mounted on the top of transverse 13.

Figure 4:
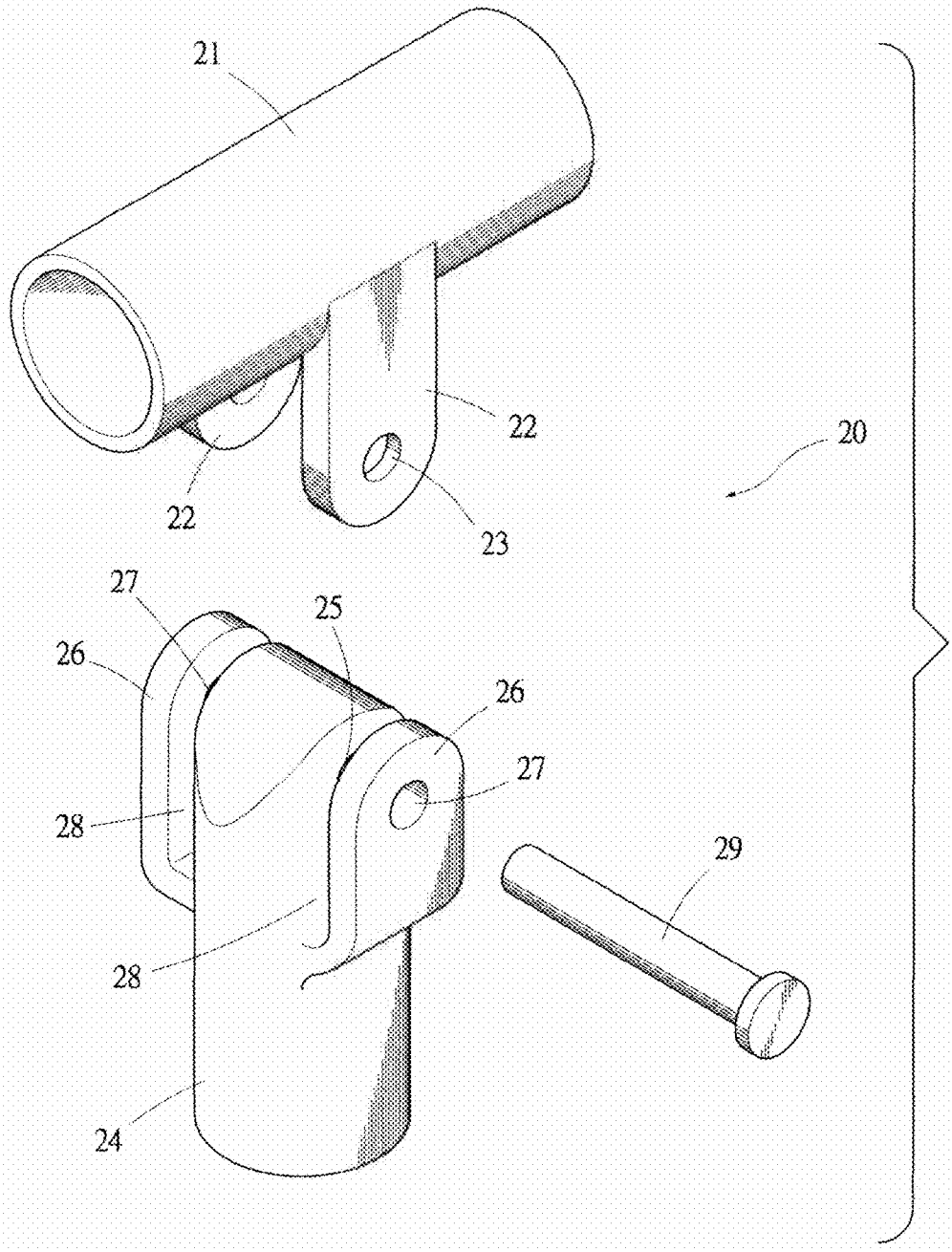
FIG. 4 shows a departed view of assembling parts of connecting device 20 in accordance with the preferred embodiment of the present invention.

With reference to the drawings and in particular to FIG. 4 which shows a departed view of assembling parts of connecting device 20 in accordance with the preferred embodiment of the present invention.

Figure 5:
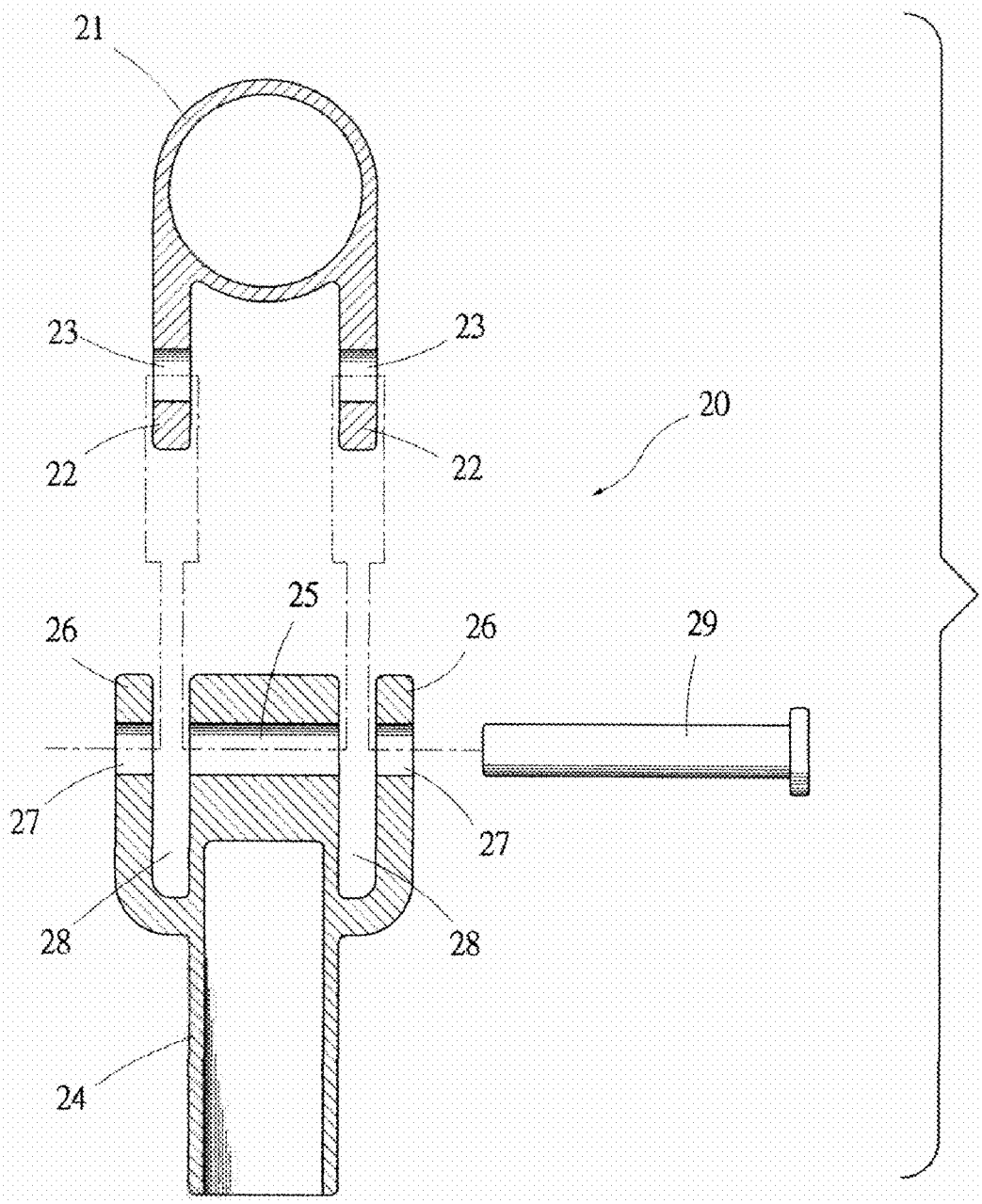
FIG. 5 shows a section view of assembling parts of connecting device 20 in accordance with preferred embodiment of the present invention.

With reference to the drawings and in particular to FIG. 5 which shows a section view of assembling parts of connecting device 20 in accordance with the preferred embodiment of the present invention.

As shown in FIGS. 4 and 5, the above-mentioned hollow tubular sleeve 21 has two symmetrical elongated wings 22, and each wing 22 bears a pinhole 23 thereon. The hollow tubular sleeve 21 can be sheathed in the middle of the lengthwise rib 14 as illustrated in FIG. 2 and pivotally joined with the socket sleeve 24 fitted on the top of the transverse rib 13.

It is also indicated in the FIGS. 4 and 5 that on the top of the said socket sleeve 24 where the central bore 25 has been pierced through and on the two symmetrical elongated wings 26 thereof where two pinholes 27 are on the same line with the central bore 25 as illustrated in FIG. 5; there are receiving slots 28 formed between two elongated wings 26 and socket sleeve 24 to properly accommodate the elongated wings 22 of the hollow tubular sleeve to be inserted.

The socket sleeve 24 is fixed upon the top of the transverse rib 13 as exemplifying as FIG. 2 in order to link with the hollow tubular 21 set on the lengthwise rib 14.

When assembling the connecting device 20 of the present invention, refer to FIG. 2. It shows that by taking use of a rivet 29 to connect the hollow tubular sleeve 21 coupled on the lengthwise rib 14 with the socket sleeve 24 fixed on the top of the transverse rib 13, contributing a connection status between lengthwise rib 14 and transverse rib 13.

In another words, as FIGS. 4 and 5 shown, when the hollow tubular sleeve 21 connects to socket sleeve 24, that means the rivet 29 must go through one of the pinhole 27 located on the elongated wing 26 of socket sleeve 24, one of the pinhole 23 existed in the elongated wing 22 of hollow tubular sleeve 21, central bore 25 on the socket sleeve 24, and then via the other pinhole 23 of the elongated wing 22 of the tubular sleeve 21, eventually through the other pinhole 27 of elongated wing 26 of socket sleeve 24 to join with hollow tubular sleeve 21 and socket sleeve 24 collectively. This structural design has largely broadened the pivoted part between hollow tubular sleeve 21 and socket sleeve 24, enhancing the connecting strength between hollow tubular sleeve 21 and socket sleeve 24; furthermore it has consolidated the stretching effect among all transverse ribs 13 and lengthwise ribs 14 and made them less worn and deformed, fulfilling the expected purpose of the invention.

In sum, by taking use of the present invention can achieve the expected function and objective; the present invention can be explainable in every detail to the extent that ordinary people who are familiar with this art to carry out based upon above preferred example. However, above embodied example is only for demonstrating purpose, all equivalent changes in its structure and resembling alterations within the scope of the spirit of the present invention should be subordinate to the category of this invention.

What is claimed is:

1. A connecting device installed on the pivoted part between a lengthwise rib and a corresponding transverse rib of an umbrella, comprising:

a hollow tubular sleeve sheathed on the lengthwise rib, the hollow tubular sleeve having a pair of symmetrical first elongated wings extending therefrom, each first elongated wing having a first pinhole formed therethrough;

a socket sleeve mounted to an end of the transverse rib and being pivotally coupled to the hollow tubular sleeve, the socket sleeve having two symmetrical second elongated wings, each second elongated wing having a second pinhole formed therethrough and disposed in aligned relationship with a central bore located adjacent a top portion of the socket sleeve, the socket sleeve having a pair of receiving slots respectively formed between the second elongated wings and the top portion of the socket sleeve for respectively receiving the pair of first elongated wings of the hollow tubular sleeve therein, the pair of first pinholes being disposed in aligned relationship with the second pinholes and the central bore; and a rivet passing through the first pinholes, the second pinholes and the central bore to provide the pivotal coupling between the hollow tubular sleeve and the socket sleeve.

* * * * *